United States Patent [19]

Faix et al.

[11] Patent Number: 4,475,314

[45] Date of Patent: Oct. 9, 1984

[54] MOUNTING ARRANGEMENT BY MEANS OF GUIDE MEMBERS FOR A TRANSPARENT WINDOWPANE

[75] Inventors: Heinz Faix, Gechingen; Winfried Schreiber, Stuttgart, both of Fed. Rep. of Germany

[73] Assignee: Daimler-Benz Aktiengesellschaft, Fed. Rep. of Germany

[21] Appl. No.: 81,893

[22] Filed: Oct. 4, 1979

[30] Foreign Application Priority Data

Oct. 6, 1978 [DE] Fed. Rep. of Germany ..... 2843633

[51] Int. Cl.[3] ..... E05F 11/38

[52] U.S. Cl. ..... 49/374; 403/90

[58] Field of Search ..... 49/227, 40, 41, 374, 49/375, 372, 349–353; 403/90, 122, 114

[56] References Cited

U.S. PATENT DOCUMENTS 3,591,983 7/1971 Hanson ..... 49/350 X 4,069,617 1/1978 Koike ..... 49/374 X 4,157,876 6/1979 Di Giulio ..... 403/90

FOREIGN PATENT DOCUMENTS 1375179 11/1974 United Kingdom ..... 403/90

*Primary Examiner*—Kenneth Downey

*Attorney, Agent, or Firm*—Craig & Burns

[57] ABSTRACT

A mounting arrangement for a transparent windowpane guided displaceably in height inside of a hollow body space of a motor vehicle by guide members. The mounting support is provided at least on the side thereof facing the transparent pane with a curved surface, against which abuts a bearing socket forming a separator with respect to the transparent pane. A fastening element connecting the bearing socket with the mounting support is so arranged and constructed that the fastening element, in the loosened condition, can be displaced, respectively, pivoted together with the bearing socket.

7 Claims, 1 Drawing Figure

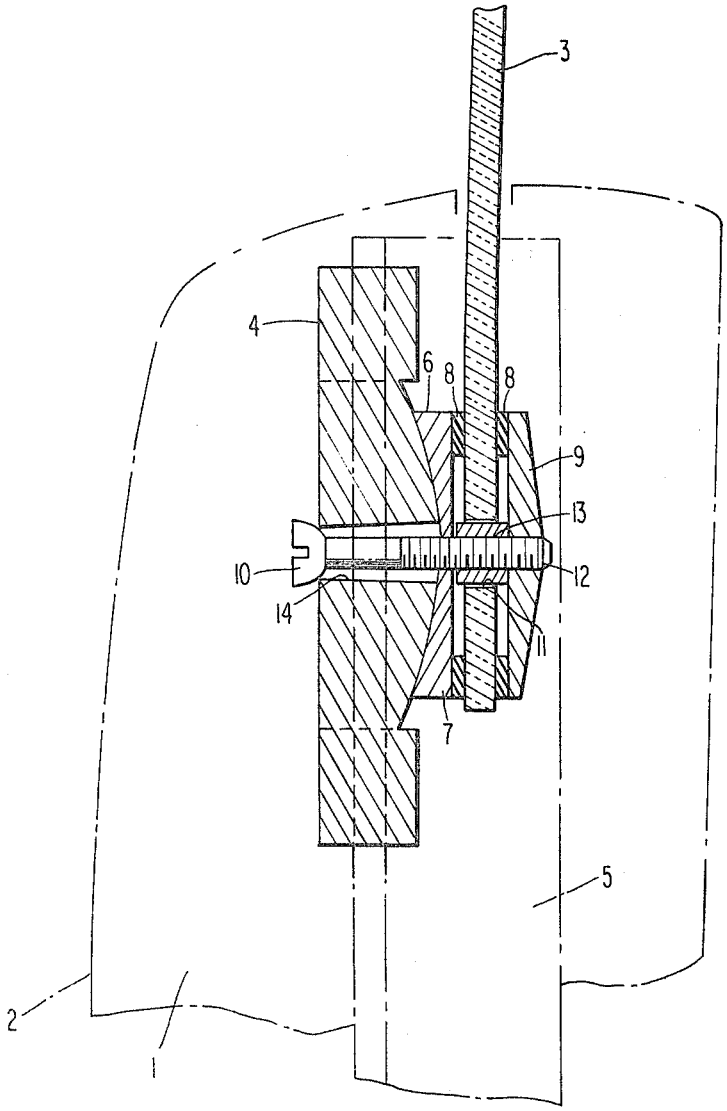
3
4
6
8
8
9
13
10
12
14
11
7
5
2
1

MOUNTING ARRANGEMENT BY MEANS OF GUIDE MEMBERS FOR A TRANSPARENT WINDOWPANE

The present invention relates to a mounting arrangement by means of guide members, for a transparent windowpane displaceably guided in height inside of a hollow space of a body of a motor vehicle.

Windowpanes guided in this manner are used as a rule as frameless side windows in coupe vehicles. In order that air drafts and window noises are avoided during the driving operation, it is necessary that the free edge areas of the windowpane which, for the most part, is constructed curved, must abut with prestress at the coordinated seals.

By reason of the dimensional deviations which occur during manufacturing especially within the edge area of the windowpanes, it is necessary to provide an adjusting possibility, by means of which the windowpane can be brought into a position matched to the requirements. It is known in connection therewith to arrange the guide rails arranged in the hollow body space pivotally about an upper fastening point.

By reason of the restricted space conditions in the corresponding hollow body space, narrow limits are imposed to the pivot range so that with larger dimensional deviations of the windowpane it may happen that, for example, the upper edge thereof presses too strongly against the coordinated seal which, in turn, causes the fastening mechanism to be difficult to operate and results in strong wear of the seals. Similarly, the situation may arise that the windowpane upper edge does not come into abutment at the seal which has, as a consequence, sealing non-tightnesses and wind noises.

It is therefore the aim of the present invention to provide an adjusting possibility for a transparent windowpane guided height-displaceably in a hollow body space of a motor vehicle by means of guide members, which compensates for even extremely large dimensional deviations of the pane.

Consequently, a mounting arrangement of the aforementioned type is proposed, whereby according to the present invention, the mounting support includes , at least on the side facing the windowpane, a curved surface, against which abuts a bearing socket forming an intermediate member or separator in the direction toward the windowpane, and whereby a fastening element connecting the bearing socket with the mounting support is so arranged and constructed that the fastening element can be displaced, respectively, pivoted in the loosened condition together with the bearing socket.

A universal windowpane adjustment is possible if the curved surface forms a spherical segment.

Accordingly, it is an object of the present invention to provide a mounting arrangement for a transparent windowpane, especially for motor vehicles, which avoids by simple means the aforementioned shortcomings and drawbacks encountered in the prior art.

Another object of the present invention resides in a mounting arrangement by means of guide members for a transparent windowpane which provides an easy adjustability of the windowpane to compensate even for large dimensional tolerances.

A further object of the present invention resides in a mounting for a transparent windowpane, especially for the door window of motor vehicles, which not only permits an adjustment of the windowpane to avoid wind noises while at the same time assuring proper sealing, particularly along the upper edge of the pane, but additionally permits a universal windowpane adjustment by extremely simple means.

Still a further object of the present invention resides in a mounting support for a transparent windowpane which effectively eliminates wind noises and leakages due to inadequate abutment of the free edge of the windowpane against the coordinated seals, especially with frameless door windows of motor vehicles.

These and other objects, features and advantages of the present invention will become more apparent from the following description when taken in connection with the accompanying drawing which shows, for purposes of illustration only, one embodiment in accordance with the present invention, and wherein:

The single FIGURE is a somewhat schematic cross-sectional view through one embodiment of a mounting arrangement for a transparent windowpane in accordance with the present invention.

Referring now to the single FIGURE of the drawing, a transparent windowpane 3 lowerable into a body hollow space 1 of a vehicle door 2 schematically indicated in dash and dooted lines, is supported at a respective guide rail 5 by way of two mounting members 4 arranged at a distance from one another and having guide jaws or wedges provided thereon—of which only one is shown for the sake of clarity.

The mounting support 4 is provided, on its side facing the windowpane 3, with a curved surface 6 which preferably forms a spherical segment. A bearing socket 7 abuts against the curved surface 6 while the transparent pane 3 is pressed against the bearing socket 7 under interposition on both sides of elastic washers 8 by way of a clamping plate 9 arranged at the end face. The mounting force is thereby produced by a fastening means 10 which in the illustrated embodiment is formed by a threaded screw with an approximately hemispherically shaped screw head. The screw extends through the mounting support 4, the bearing socket 7 and the transparent windowpane 3—which, for that purpose, is provided with one bore 11 each—whereas its threaded end section 12 is received by the clamping plate 9.

The diameter of the bore 11 is so dimensioned that the fastening means 10 is extended therethrough with clearance and the same is compensated for by a spacer element 13 of elastic material. The length thereof is so chosen that the spacer element 13 is not compressed during the fastening of the transparent pane 8—as viewed in the axial direction of the fastening means 10—and thus does not serve for the transmission of force.

The bore 14 provided in the mounting support 4 may be flared so as to become larger in the direction toward the windowpane 3 so that a sufficiently large universal pivot range results. It is possible as a result thereof to so adjust the windowpane 3 that the closing force thereof is attained accurately and the clamping place of the transparent windowpane is stressed only with the predetermined force. During this adjusting operation which can be carried out in a simple manner, for example, with the assistance of a suitable mechanism still prior to the installation of the windowpane 3 into the hollow body space 1, the approximately hemispherically shaped head of the fastening means 10 will be centered.

In lieu of the illustrated arrangement of the fastening means, also other arrangements are possible within the scope of the present invention. Thus, the fastening means may also consist, for example, of a pivotal threaded pin projecting from the guide member. However, it is also possible to construct the side of the guide member opposite the curved surface in a similar manner and to adjust the transparent pane by displacement of the bearing socket.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A mounting arrangement with guide means for a transparent windowpane height-displaceably guided inside a hollow space of a motor vehicle, characterized in that a mounting means is arranged on the guide means for supporting the windowpane, the mounting means is provided with a curved surface means on at least a side thereof facing the windowpane, a bearing socket means is interposed between the curved surface means and the windowpane, the curved surface means is adapted to abut the bearing socket means, and in that a fastening means operatively connects the bearing socket means with the mounting support means, the fastening means is arranged and constructed so that, in a loosened condition of the fastening means, the fastening means can be displaced together with the bearing socket means so as to enable an adjustment of the windowpane relative to the mounting means, whereby, upon a tightening of the fastening means, the adjustment of the windowpane relative to the mounting means is fixed.

2. A mounting arrangement according to claim 1, characterized in that the displacement of the fastening means and the bearing socket means is a pivotal displacement.

3. A mounting arrangement according to claim 1 or 2, characterized in that the curved surface means is in the form of a spherical segment.

4. A mounting arrangement according to claim 2, characterized in that the fastening means includes a threaded screw having an at least approximately hemispherically shaped screw head.

5. A mounting arrangement according to claim 4, characterized in that the fastening means extends through a bore in the mounting support means, the bearing socket means and a bore in the windowpane.

6. A mounting arrangement according to claim 5, characterized in that the bore in the mounting means widens in a direction toward the windowpane.

7. A mounting arrangement according to any one of claims 1, 2, 3, 4, 5, or 6, characterized in that the fastening means extends with clearance through a bore in the windowpane, and in that an elastic sleeve surrounds the fastening means within the area of the windowpane bore.

* * * * *